US010940709B2

(12) United States Patent
Robles Flores et al.

(10) Patent No.: US 10,940,709 B2
(45) Date of Patent: Mar. 9, 2021

(54) PRINTABLE MEDIA AND METHODS FOR FORMING AN IMAGE ON THE SAME

(71) Applicant: Xerox Corporation, Norwalk, CT (US)

(72) Inventors: Eliud Robles Flores, Rochester, NY (US); William G. Osbourne, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 62 days.

(21) Appl. No.: 16/180,762

(22) Filed: Nov. 5, 2018

(65) Prior Publication Data

US 2020/0139738 A1 May 7, 2020

(51) Int. Cl.
*B41M 5/00* (2006.01)
*B41M 5/50* (2006.01)

(52) U.S. Cl.
CPC ..... *B41M 5/0011* (2013.01); *B41M 5/502* (2013.01)

(58) Field of Classification Search
CPC ..... B41M 1/30; B41M 5/506; B41M 5/508; B41M 5/0064; B41M 5/0011; B41M 5/502; B41M 5/0047; G03G 15/6591; G03G 7/0086; G03G 7/0093
See application file for complete search history.

(56) References Cited

U.S. PATENT DOCUMENTS

| | | | | |
|---|---|---|---|---|
| 5,519,481 | A | 5/1996 | Kuo | |
| 5,848,347 | A | 12/1998 | Kuo et al. | |
| 6,002,913 | A | 12/1999 | Pawlik et al. | |
| 7,424,246 | B2 | 9/2008 | Spence et al. | |
| 7,437,120 | B2 | 10/2008 | Ruthenberg et al. | |
| 7,809,323 | B2 | 10/2010 | Johnston et al. | |
| 9,710,203 | B2 | 7/2017 | Van Acquoij | |
| 2004/0062897 | A1* | 4/2004 | Samii | B41J 11/005 428/40.1 |
| 2014/0295099 | A1* | 10/2014 | Napper | C09D 175/04 427/542 |
| 2016/0103633 | A1 | 4/2016 | Huijbers et al. | |
| 2017/0225498 | A1 | 8/2017 | Van Acquoij et al. | |
| 2019/0105932 | A1* | 4/2019 | Nguyen | B32B 27/36 |

OTHER PUBLICATIONS

U.S. Appl. No. 16/180,713, filed Nov. 5, 2018.
U.S. Appl. No. 16/180,813, filed Nov. 5, 2018.

* cited by examiner

*Primary Examiner* — Vishal I Patel
(74) *Attorney, Agent, or Firm* — Simpson & Simpson, PLLC; Michael Nicholas Vranjes

(57) ABSTRACT

A printable media including a carrier layer, a fabric layer and a first adhesive. The carrier layer includes a first surface having a first area, a second surface opposite the first surface, and a first rigidity. The fabric layer includes a third surface, a fourth surface opposite the third surface and including a second area, and a second rigidity less than the first rigidity. The fabric layer is secured to the carrier layer by the first adhesive bonding a first portion of the fourth surface to the first surface.

7 Claims, 17 Drawing Sheets

PRINTABLE MEDIA AND METHODS FOR FORMING AN IMAGE ON THE SAME

TECHNICAL FIELD

The presently disclosed embodiments are directed to providing a printable media, in particular to a printable media including a fabric layer, and even more particularly to a printable media including a supporting carrier layer and printable fabric layer attached thereto. Additionally, the presently disclosed embodiments are directed to methods of forming an image on the foregoing printable media.

BACKGROUND

Forming images, e.g., printing, on paper is well known in the art. Offset printing, xerography, ink deposition, etc. have been used for many years to form images and text on paper media. However, as time has advanced, the desire to print on substrates other than traditional paper media has become increasingly of interest. While forming images on paper is well known and reasonably predictable, forming images on various other substrates has been difficult to accomplish and results can vary dramatically. For example, xerographic printing on card stock can produce high image quality having durability if fusing is properly performed, or may result in an image that rubs off of the card stock if fusing is inadequate. Forming images on less common materials such as fabrics, tissue paper, and other malleable materials, using traditional image forming techniques has been difficult, inconsistent and limited in application. Thus, known systems that form images on fabrics and malleable materials are slow and lack high image quality.

Moreover, known systems that traditionally form images on paper substrates are limited in the size of the paper substrate that can be used, e.g., 11"×17". Even new systems such as the system described in the concurrently filed application entitled "SYSTEM, APPARATUS, AND METHOD FOR PRINTING LARGE FORMAT MEDIA AND TARGETED DECURLING OF VARIOUS PRINTING PROCESSES", which system dramatically improves the capabilities of known printing systems, are limited to media lengths similar to the distance between the image formation zone and fuser/dryer, and are limited to widths similar to the fixed width print heads or cross process movement of print heads. Increasing the size, i.e., length and/or width, of a printed article has always been a difficult task. The primary reason for this issue is that printer hardware is designed for certain dimensions, and hardware flexibility and extensibility are difficult to plan for without increased costs and complexity.

The present disclosure addresses a printable media and method for forming an image on the same that overcomes the foregoing system shortcomings.

SUMMARY

Broadly, the apparatus and methods discussed infra provide the ability to print extra-large images on malleable substrates for a variety of applications. The apparatus, which is in-turn used by the disclosed methods, broadly includes a liner-backed malleable material, e.g., a fabric, and enables practical, cost effective applications for forming images on malleable materials such as fabrics, including but not limited to cotton fabrics, natural fiber fabrics, synthetic fiber fabrics, canvas, etc., as well as other malleable materials such as tissue and crêpe paper.

The presently disclosed embodiments utilize various liner arrangements that, in addition to facilitating forming images on malleable materials, also facilitates forming images on large format media, specifically media larger than a printing system could conventionally handle due to fixed hardware constraints.

According to aspects illustrated herein, there is provided a printable media including a carrier layer, a fabric layer and a first adhesive. The carrier layer includes a first surface having a first area, a second surface opposite the first surface, and a first rigidity. The fabric layer includes a third surface, a fourth surface opposite the third surface and including a second area, and a second rigidity less than the first rigidity. The fabric layer is secured to the carrier layer by the first adhesive bonding a first portion of the fourth surface to the first surface.

According to other aspects illustrated herein, there is provided a method of forming an image on a print media including: releasably securing a fabric layer to a carrier layer, the carrier layer having a first surface including a first area, a second surface opposite the first surface, and a first rigidity, the fabric layer including a third surface, a fourth surface opposite the third surface and having a second area, and a second rigidity less than the first rigidity, wherein the fabric layer is secured to the carrier layer by a first adhesive bonding a first portion of the fourth surface to the first surface; applying a first dry marking material to a first portion of the third surface of the fabric layer; and, fusing the first dry marking material to the first portion of the third surface with a first fuser.

According to still other aspects illustrated herein, there is provided a method of forming an image on a print media including: releasably securing a fabric layer to a carrier layer, the carrier layer including a first surface having a first area, a second surface opposite the first surface, and a first rigidity, the fabric layer including a third surface, a fourth surface opposite the third surface and having a second area, and a second rigidity less than the first rigidity, and a first adhesive, wherein the fabric layer is secured to the carrier layer by the first adhesive bonding a first portion of the fourth surface to the first surface; applying a first liquid marking material to a first portion of the third surface of the fabric layer; and, drying the first liquid marking material to the first portion of the third surface with a first dryer.

Other objects, features and advantages of one or more embodiments will be readily appreciable from the following detailed description and from the accompanying drawings and claims.

BRIEF DESCRIPTION OF THE DRAWINGS

Various embodiments are disclosed, by way of example only, with reference to the accompanying drawings in which corresponding reference symbols indicate corresponding parts, in which.

DETAILED DESCRIPTION

Figure 1:
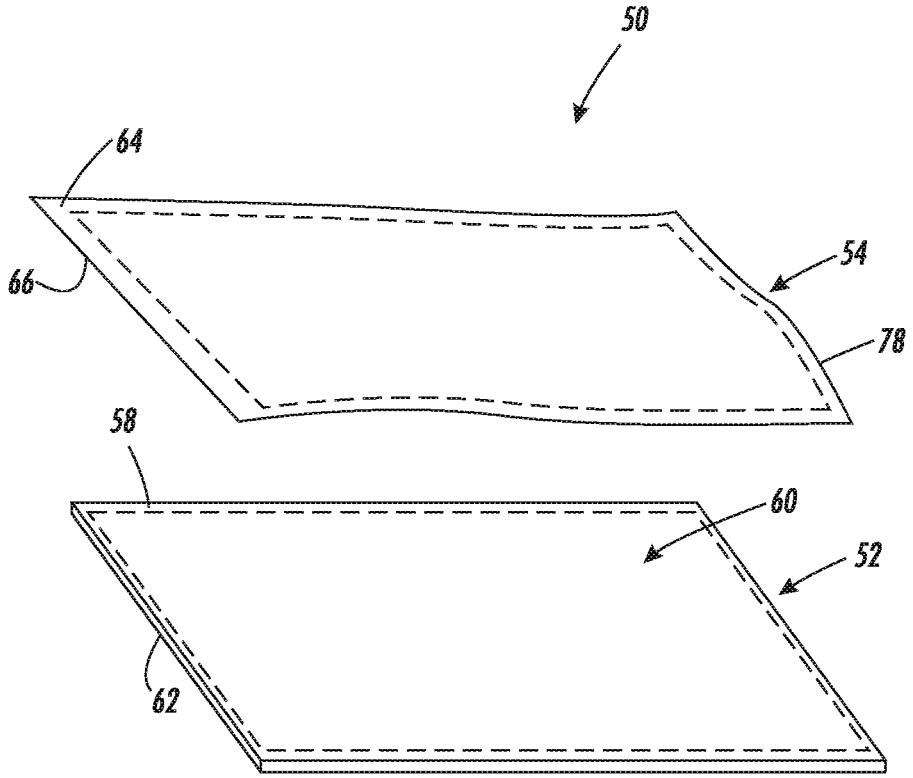
FIG. 1 is a perspective view of an embodiment of a carrier layer and a fabric layer separated from each other.
Figure 2:
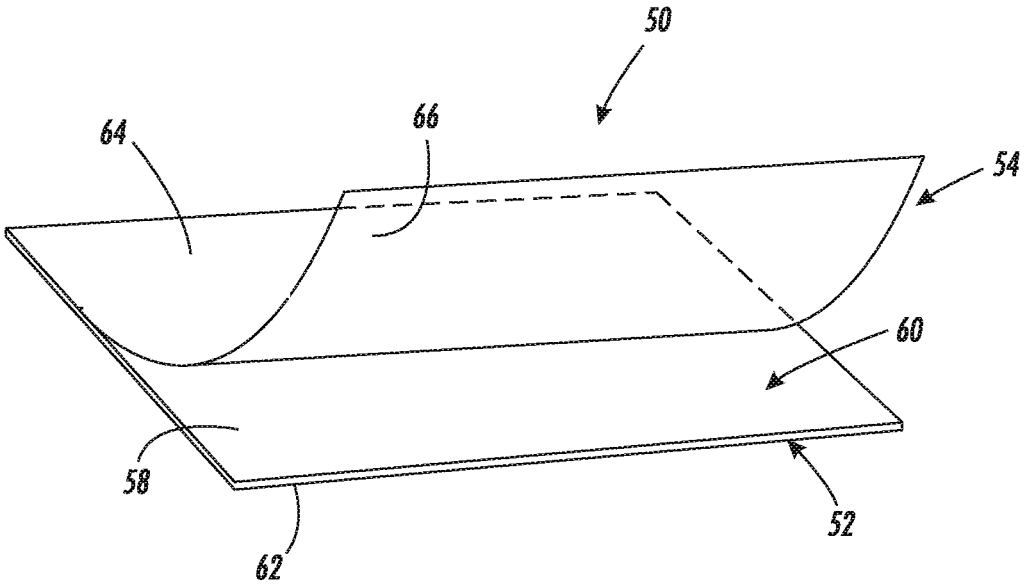
FIG. 2 is a perspective view of an embodiment of a carrier layer and a fabric layer partially separated from each other.
Figure 3:
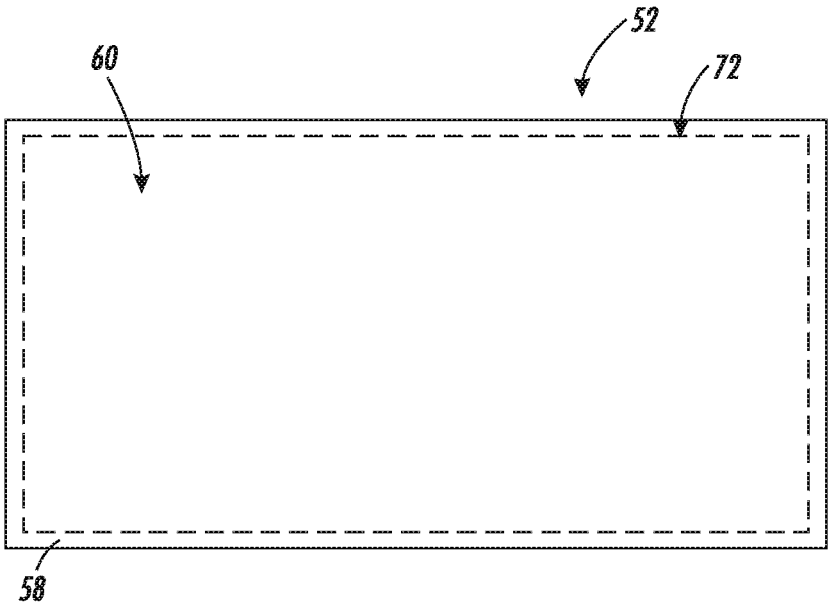
FIG. 3 is a plan view of a first surface of an embodiment of a carrier layer.
Figure 4:
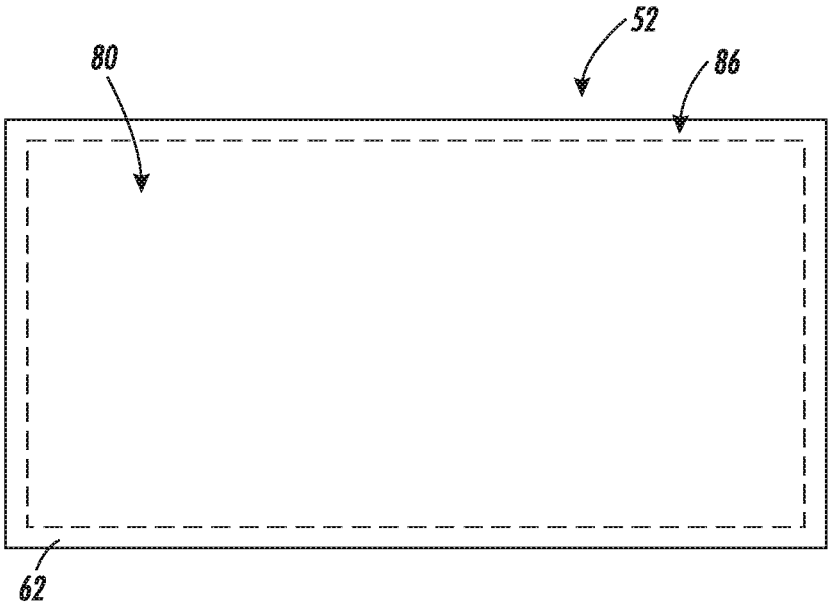
FIG. 4 is a plan view of a second surface of an embodiment of a carrier layer, arranged opposite the first surface depicted in FIG. 3.
Figure 5:
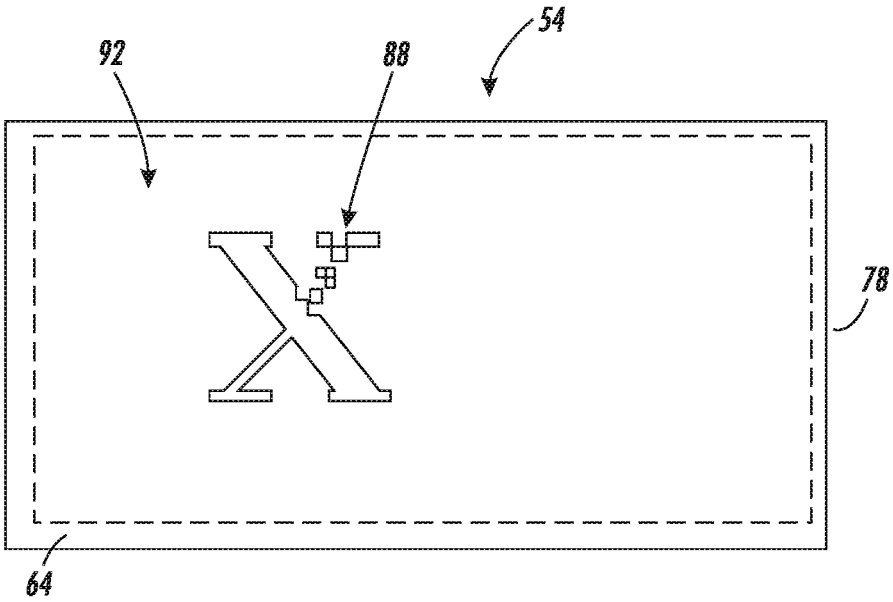
FIG. 5 is a plan view of a first surface of an embodiment of a fabric layer.
Figure 6:
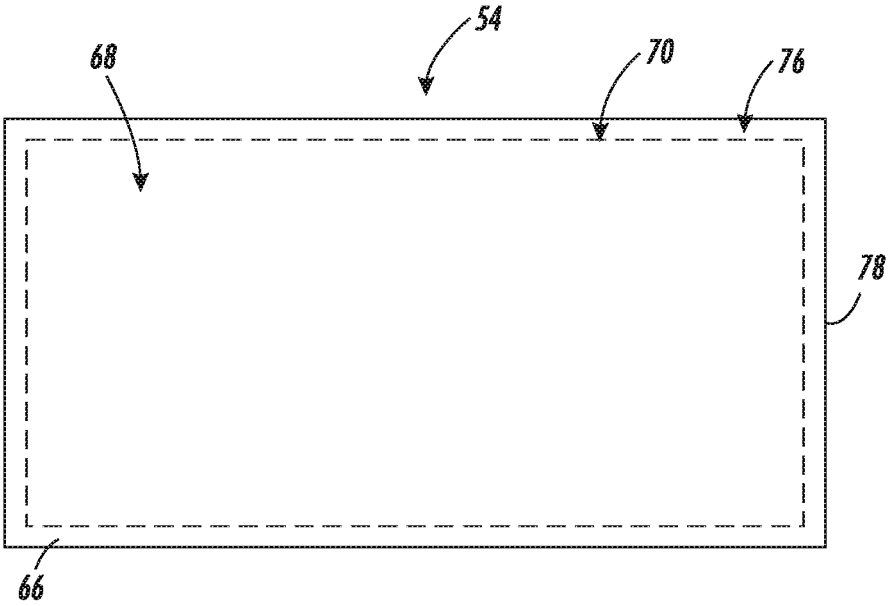
FIG. 6 is a plan view of a second surface of an embodiment of a fabric layer, arranged opposite the first surface depicted in FIG. 5.
Figure 7:
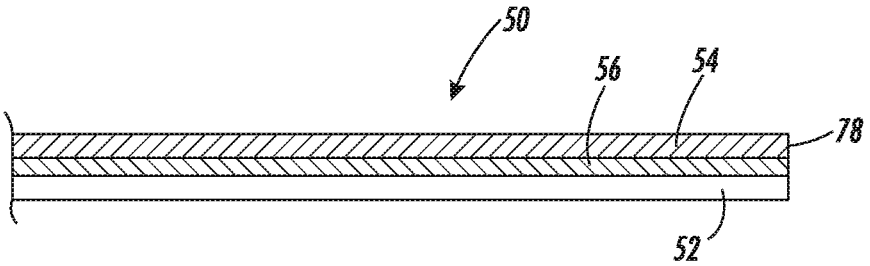
FIG. 7 is a cross sectional view of an embodiment of a present printable media depicting a fabric layer releasably secured to a carrier layer via an adhesive.
Figure 8:
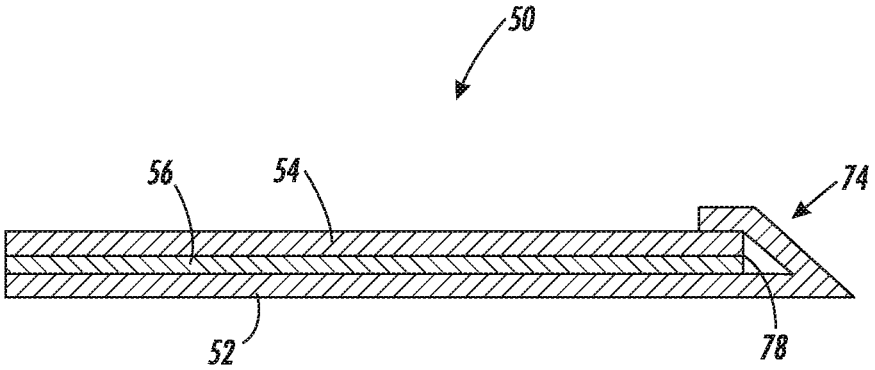
FIG. 8 is a cross sectional view of an embodiment of a present printable media depicting a fabric layer releasably secured to a carrier layer via an adhesive with the carrier layer including a lead edge flap.
Figure 9:
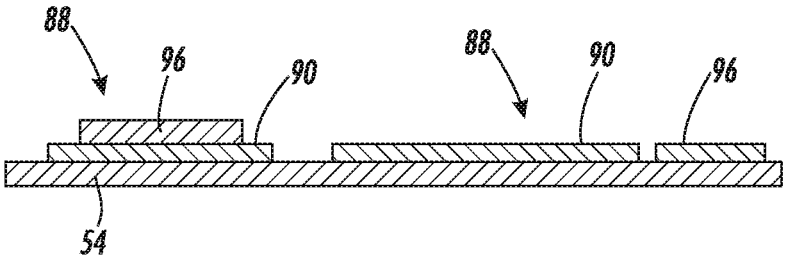
FIG. 9 is a cross sectional view of an embodiment of a fabric layer depicting various embodiments of depositing first and second dry marking materials.
Figure 10:
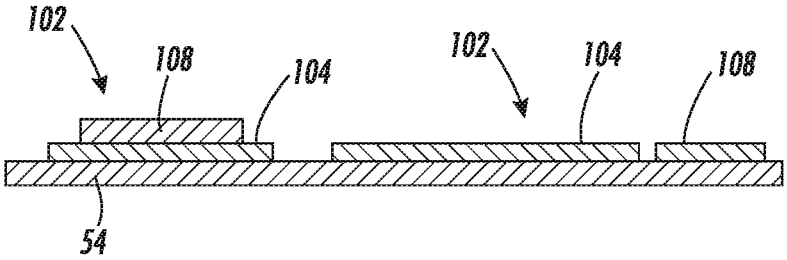
FIG. 10 is a cross sectional view of an embodiment of a fabric layer depicting various embodiments of depositing first and second liquid marking materials.
Figure 11:
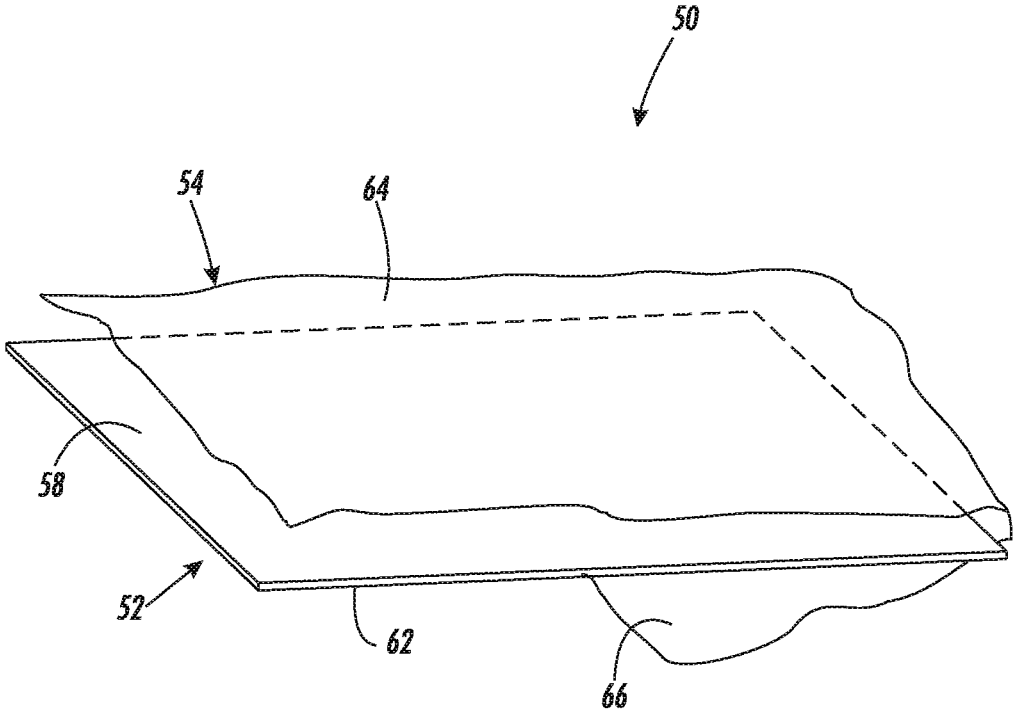
FIG. 11 is a perspective view of an embodiment of a carrier layer and a fabric layer separated from each other where the fabric layer at least partially wraps around the carrier layer.
Figure 12:
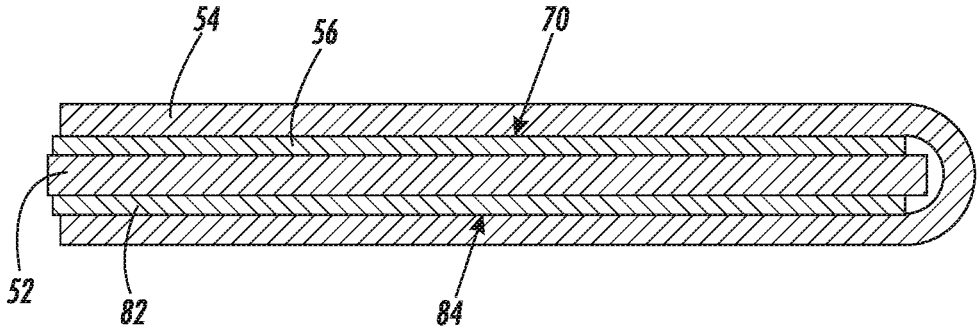
FIG. 12 is a cross sectional view of an embodiment of a present printable media depicting a fabric layer releasably secured simultaneously to first and second sides of a carrier layer via an adhesive.
Figure 13:
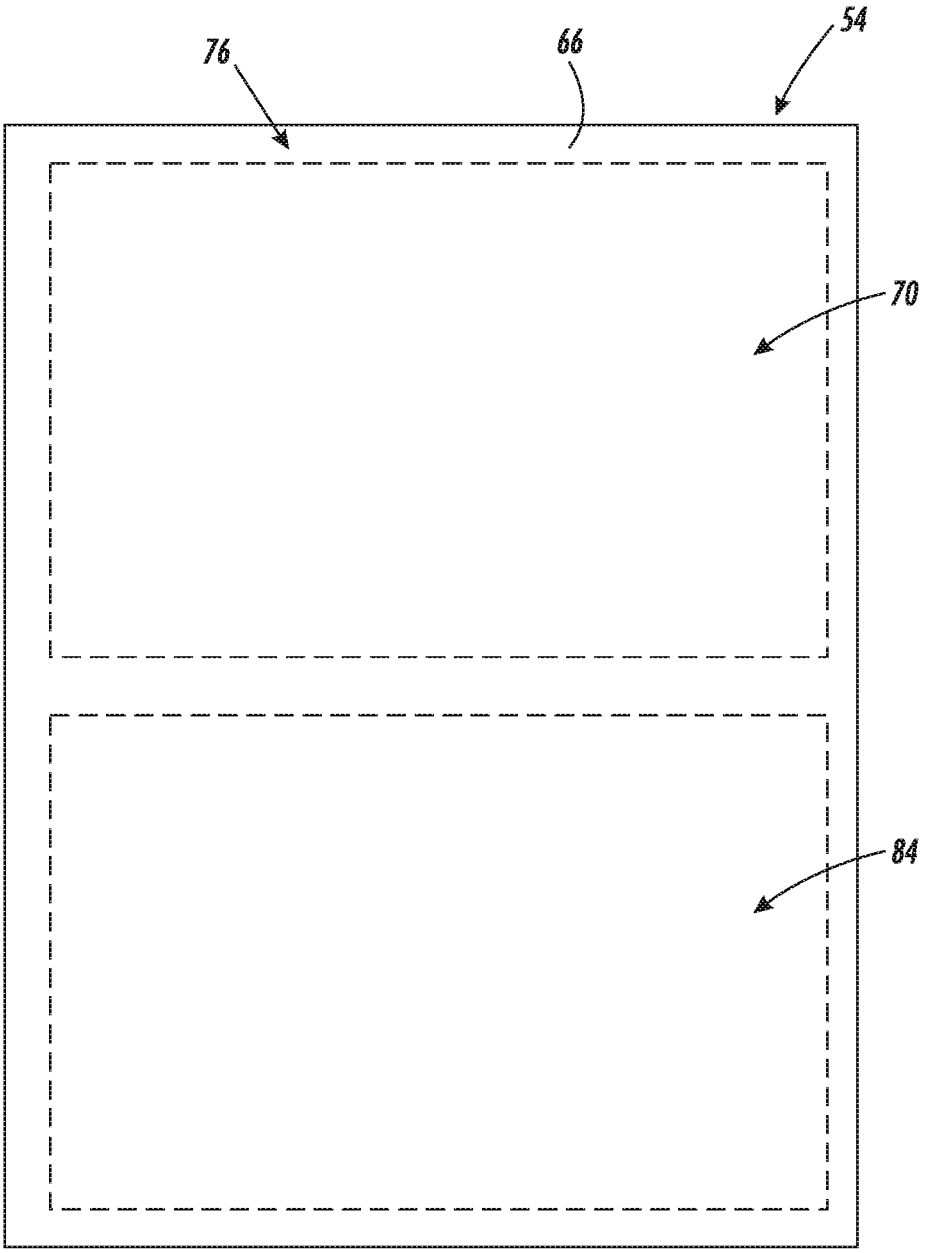
FIG. 13 is a top plan view of an embodiment of a first surface of a fabric layer having first and second portions arranged to be simultaneously secured to first and second surfaces of a carrier layer.
Figure 14:
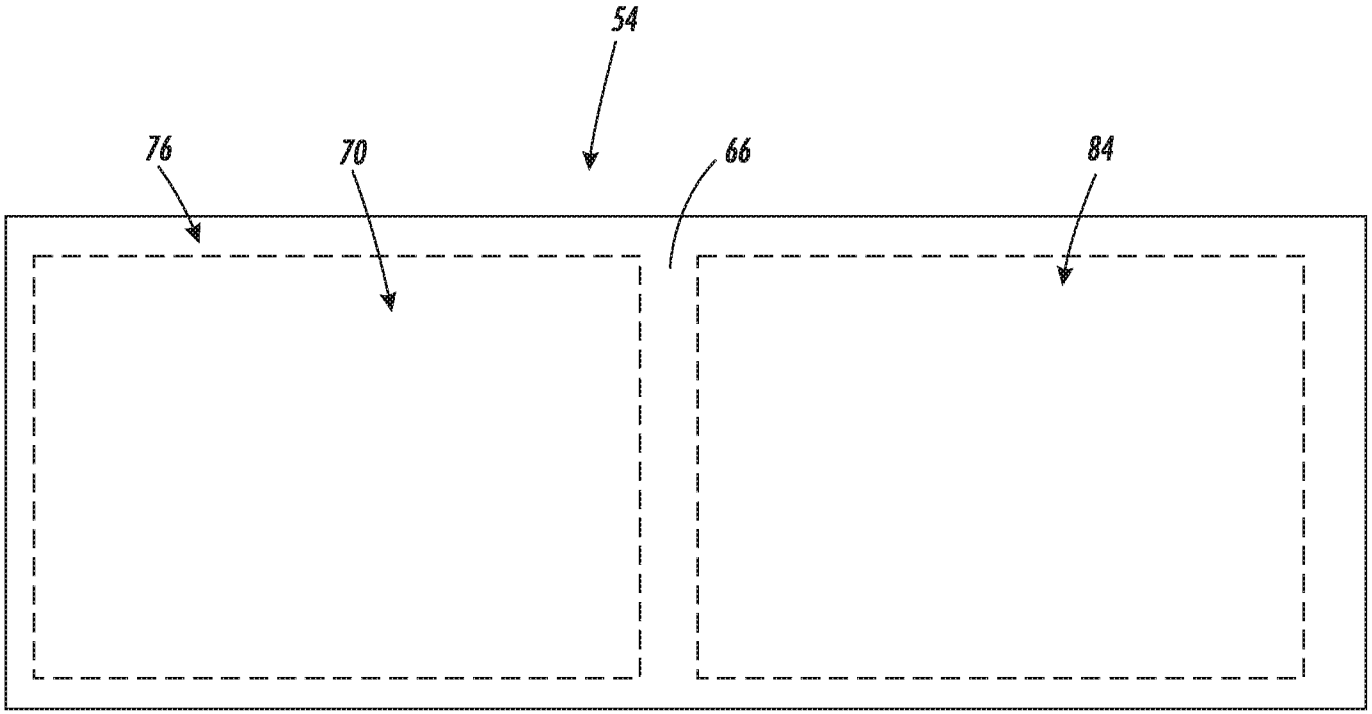
FIG. 14 is a top plan view of an embodiment of a first surface of a fabric layer having first and second portions arranged to be simultaneously secured to first and second surfaces of a carrier layer.
Figure 15:
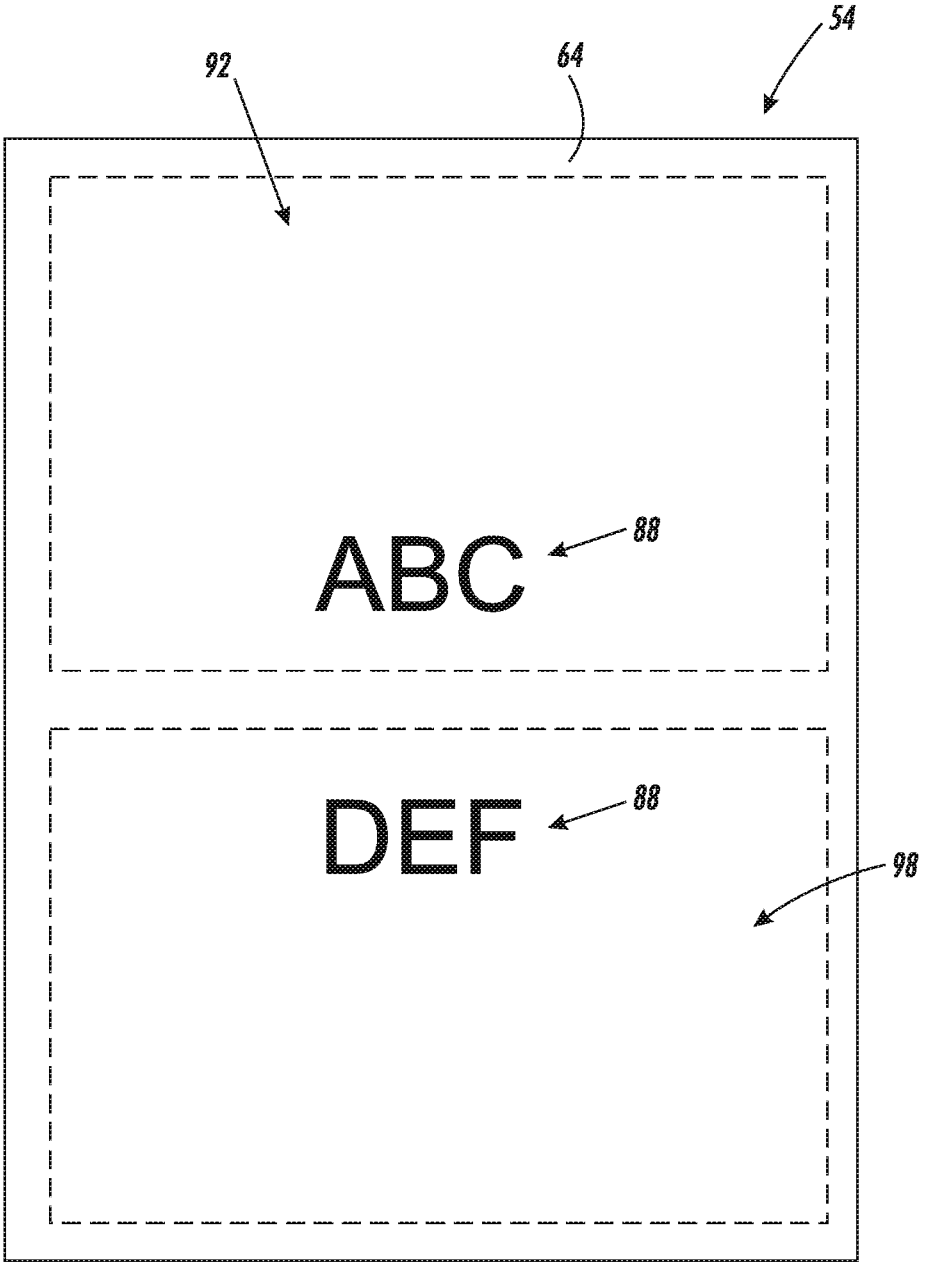
FIG. 15 is a top plan view of an embodiment of a second surface of a fabric layer, opposite the first surface depicted in FIG. 13, having first and second portions arranged to receive printed images thereon.
Figure 16:
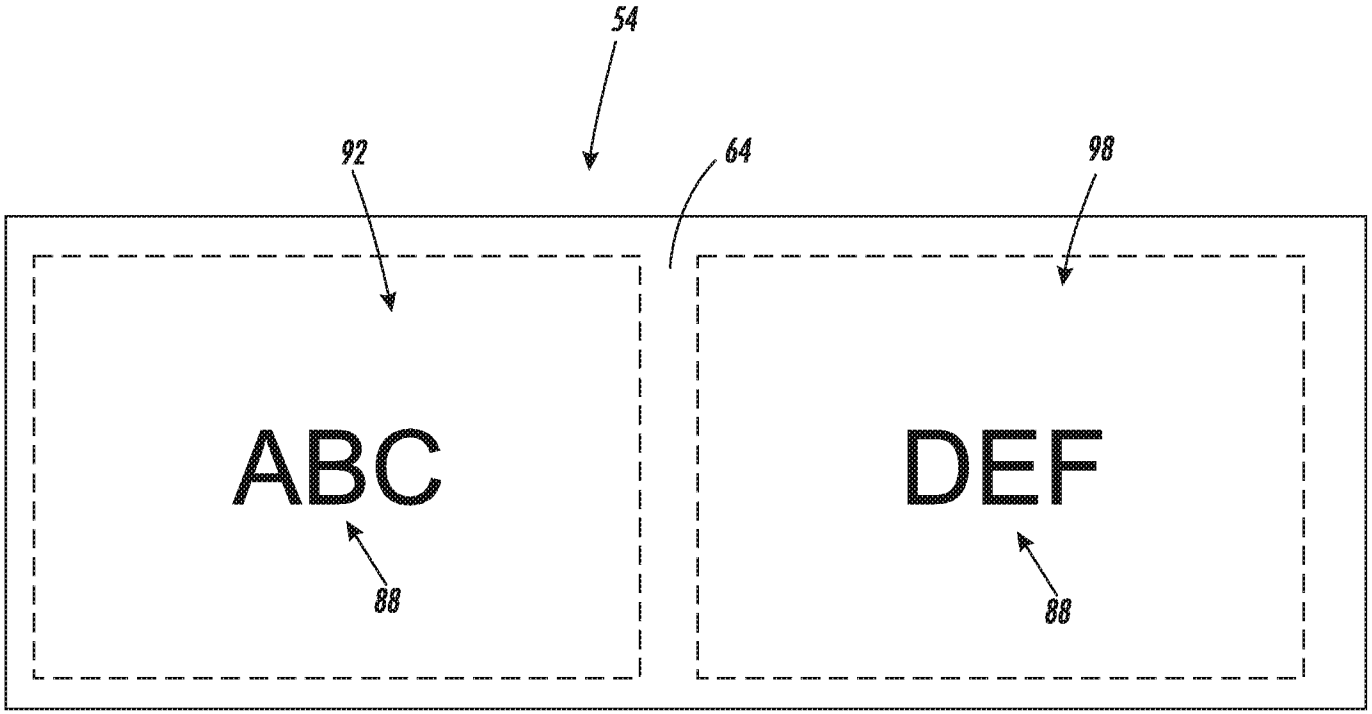
FIG. 16 is a top plan view of an embodiment of a second surface of a fabric layer, opposite the first surface depicted in FIG. 14, having first and second portions arranged to receive printed images thereon.
Figure 17:
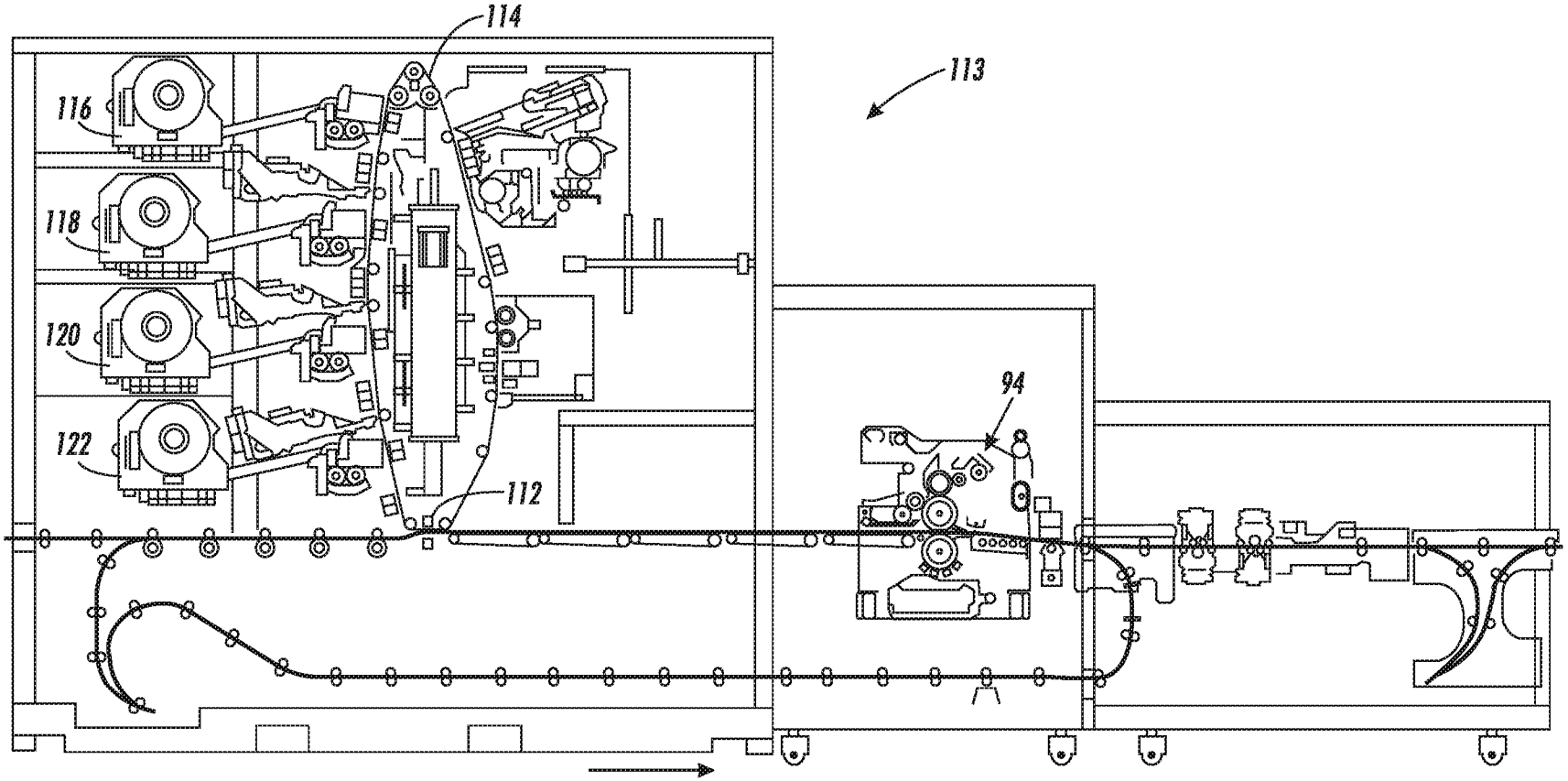
FIG. 17 is a side elevational view of an embodiment of a printing system having a single fuser and arranged to deposit dry marking material on a present printable media.
Figure 18:
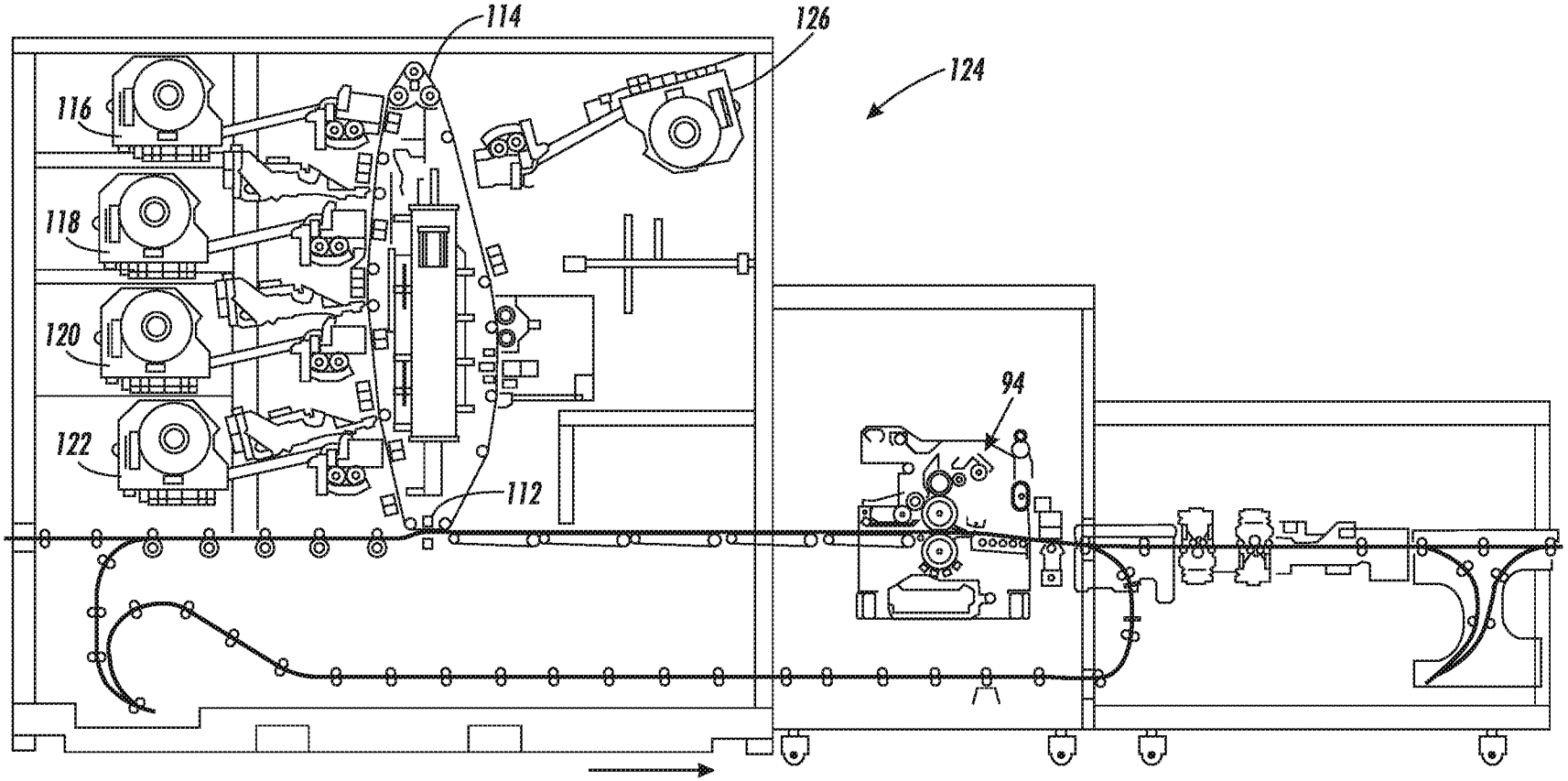
FIG. 18 is a side elevational view of an embodiment of a printing system having a single fuser and arranged to deposit dry marking material on a present printable media.
Figure 19:
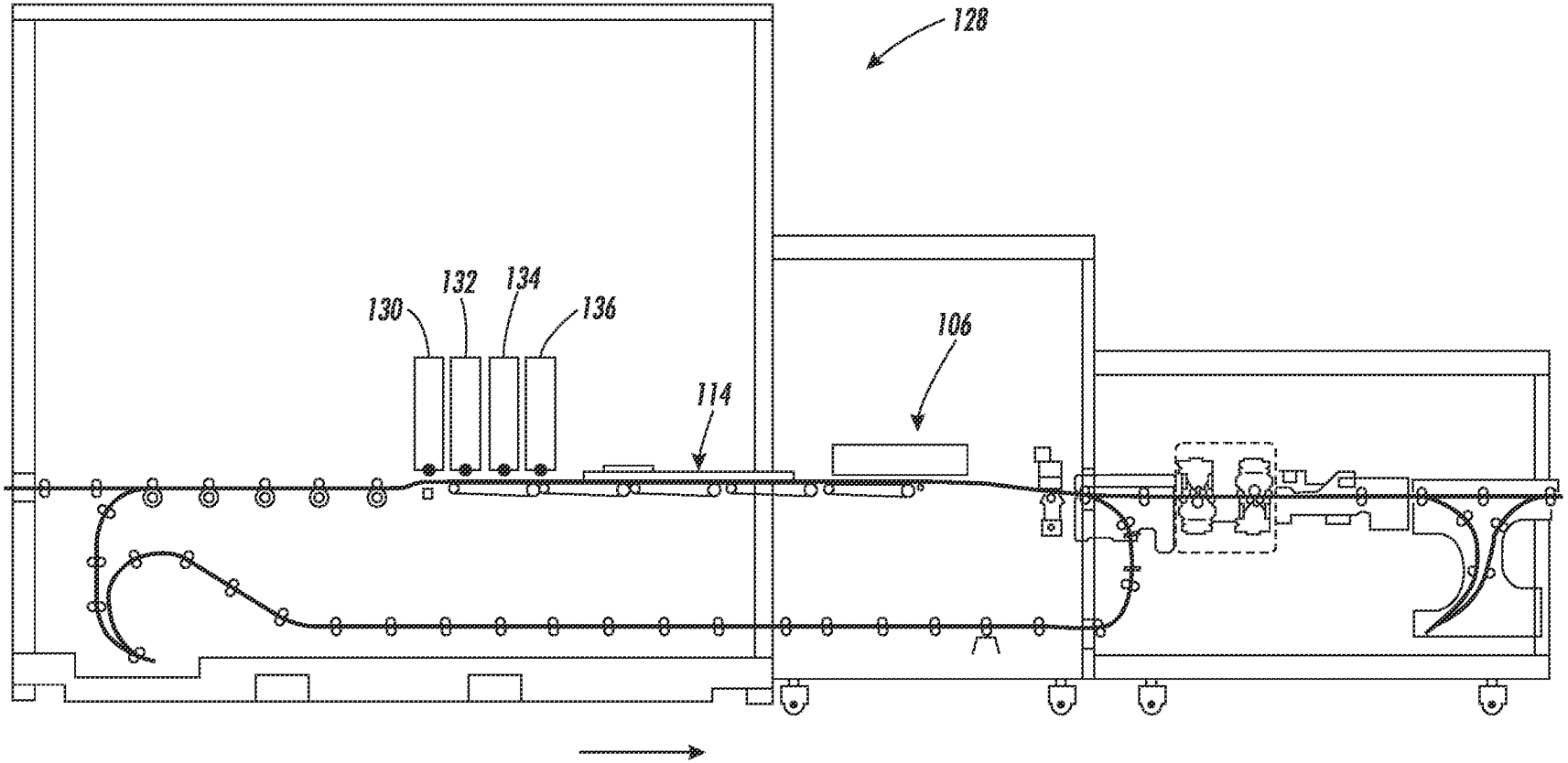
FIG. 19 is a side elevational view of an embodiment of a printing system having a single dryer and arranged to deposit liquid marking material on a present printable media.
Figure 20:
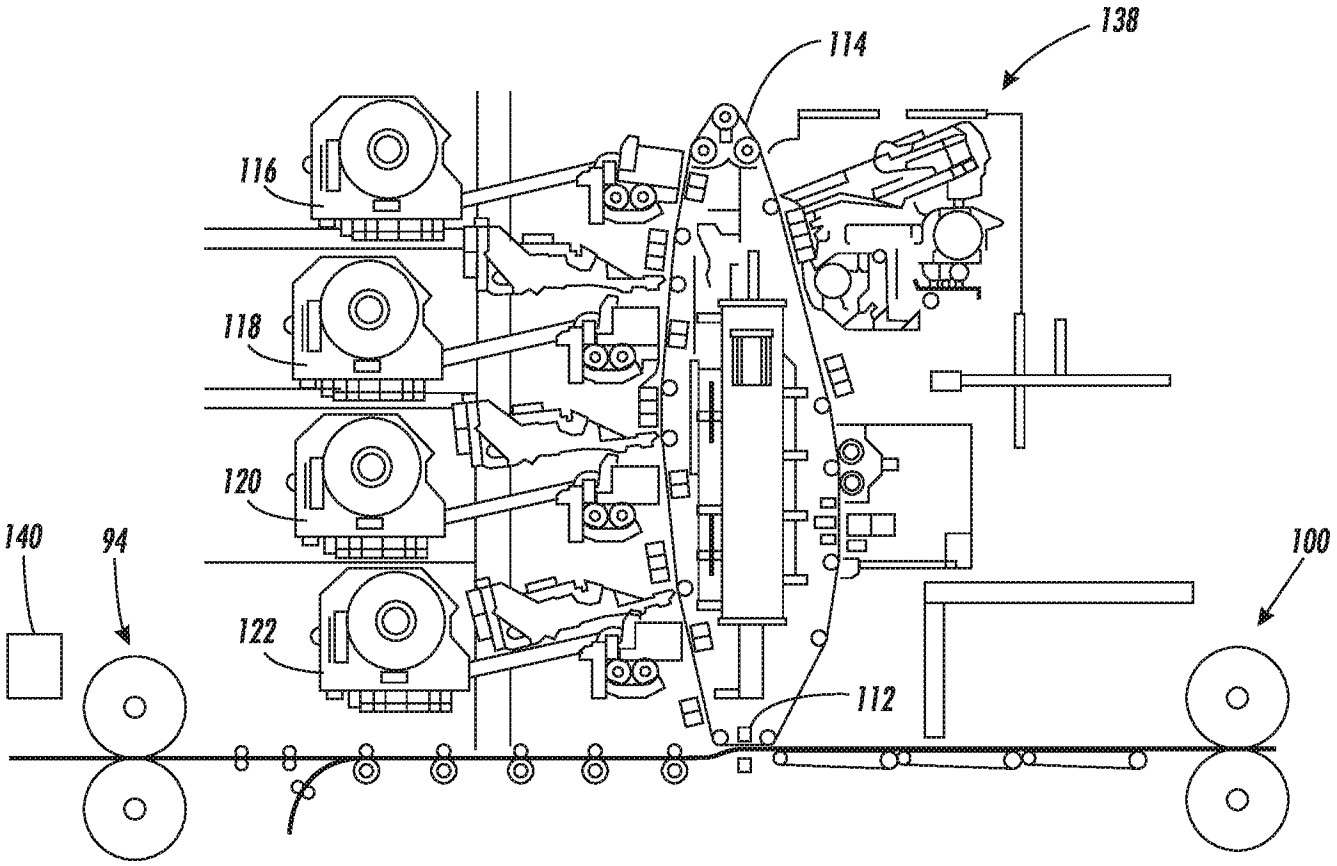
FIG. 20 is a side elevational view of an embodiment of a printing system having first and second fusers and arranged to deposit dry marking material on a present printable media; and, FIG. 21 is a side elevational view of an embodiment of a printing system having first and second dryers and arranged to deposit liquid marking material on a present printable media.
Figure 21:
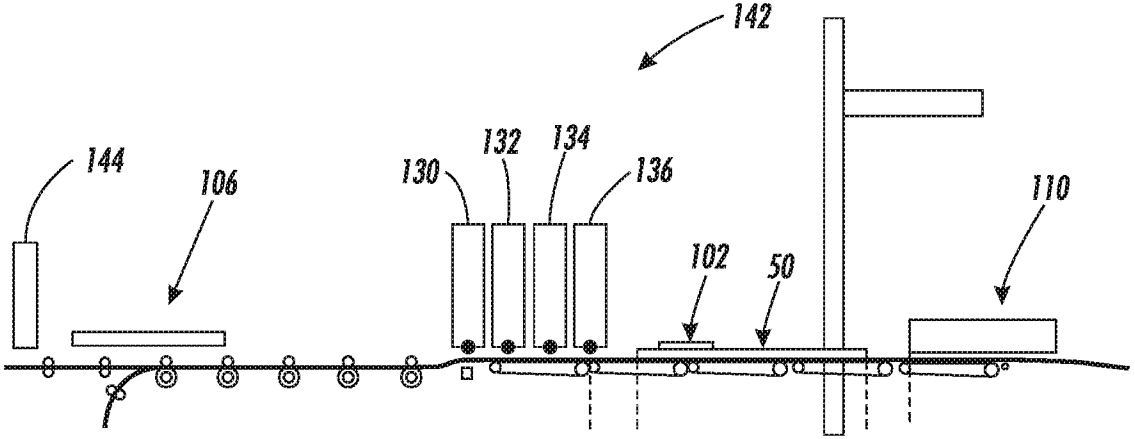

At the outset, it should be appreciated that like drawing numbers on different drawing views identify identical, or functionally similar, structural elements of the embodiments set forth herein. Furthermore, it is understood that these embodiments are not limited to the particular methodologies, materials and modifications described and as such may, of course, vary. It is also understood that the terminology used herein is for the purpose of describing particular aspects only, and is not intended to limit the scope of the disclosed embodiments, which are limited only by the appended claims.

Unless defined otherwise, all technical and scientific terms used herein have the same meaning as commonly understood to one of ordinary skill in the art to which these embodiments belong. It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

"Process direction", as used herein, is intended to mean the direction print media travels through the system, while "cross-process direction" is intended to mean the direction perpendicular to the process direction. As used herein, "full width", e.g., "full width array sensor" and "full width printhead array", is intended to be broadly construed as any structure that covers a significant width of the substrate. A "full width array sensor" comprises at least one linear array of photosensors, arranged perpendicular to the process direction and capable of capturing/recording image data at a size relevant to the control system. For example, in some embodiments, the length of a full width array sensor is approximately half of the width of the substrate which it inspects. Moreover, the words "printer," "printer system", "printing system", "printer device" and "printing device" as used herein encompasses any apparatus, such as a digital copier, bookmaking machine, facsimile machine, multi-function machine, etc. which performs a print outputting function for any purpose, while "multi-function device" and "MFD" as used herein is intended to mean a device which includes a plurality of different imaging devices, including but not limited to, a printer, a copier, a fax machine and/or a scanner, and may further provide a connection to a local area network, a wide area network, an Ethernet based network or the internet, either via a wired connection or a wireless connection. An MFD can further refer to any hardware that combines several functions in one unit. For example, MFDs may include but are not limited to a standalone printer, one or more personal computers, a standalone scanner, a mobile phone, an MP3 player, audio electronics, video electronics, GPS systems, televisions, recording and/or reproducing media or any other type of consumer or non-consumer analog and/or digital electronics. Additionally, as used herein, "sheet," "sheet of paper" and "paper" refer to, for example, paper, transparencies, parchment, film, fabric, plastic, photo-finishing papers or other coated or non-coated substrate media in the form of a web upon which information or markings can be visualized and/or reproduced.

As used herein, "fusing," with respect to dry marking material such as toner, is intended to mean supplying heat energy and/or pressure, having the effect of slightly liquifying the applied dry marking material (toner) particles, in turn causing them to adhere to a surface. "Drying," as used herein, is intended to mean applying energy, typically but not necessarily heat in radiant and/or convective form, having the effect of causing a liquid component of the ink (a liquid marking material) to evaporate. "Curing," as used herein, for example with respect to IR inks (liquid marking material) is intended to mean applying energy, such as by typically but not necessarily infrared waves, having the effect of causing a chemical reaction within at least one component of the applied ink, thereby fixing the ink to a surface.

As used herein, the term 'average' shall be construed broadly to include any calculation in which a result datum or decision is obtained based on a plurality of input data, which can include but is not limited to, weighted averages, yes or no decisions based on rolling inputs, etc. Moreover, as used herein, the phrases "comprises at least one of" and "comprising at least one of" in combination with a system or element is intended to mean that the system or element includes one or more of the elements listed after the phrase. For example, a device comprising at least one of: a first element; a second element; and, a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element. A similar interpretation is intended when the phrase "used in at least one of:" is used herein. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

Moreover, although any methods, devices or materials similar or equivalent to those described herein can be used in the practice or testing of these embodiments, some embodiments of methods, devices, and materials are now described.

Broadly, in some embodiments, printable media 50 comprises carrier layer 52, fabric layer 54 and adhesive 56. Carrier layer 52 comprises surface 58 comprising area 60, surface 62 opposite surface 58, and a first rigidity. Fabric layer 54 comprises surface 64, surface 66 opposite surface 64 and comprising area 68, and a second rigidity less than the first rigidity. Fabric layer 54 is secured to carrier layer 52 by adhesive 56 bonding portion 70 of surface 66 to surface 58.

In some embodiments, adhesive 56 is deposited on area 60, and in some of those embodiments, area 60 is less than or equal to total area 72 of surface 58. In some embodiments, adhesive 56 is deposited on area 68, and in some of those embodiments, area 68 is less than or equal to total area 72 of surface 58. In some embodiments, area 60 is substantially equal to area 68. In summary, an adhesive may be deposited on the carrier layer and/or on the fabric layer. Moreover, the adhesive may be deposited on an area less than or equal to total surface area of the carrier layer and/or the fabric layer.

In some embodiments, carrier layer 52 further comprises lead edge flap 74. Adhesive 56 is deposited in an area less than total area 76 of surface 66. Lead edge flap 74 partially contains lead edge 78 of fabric layer 54. Thus, in these embodiments, the carrier layer includes a flap arranged adjacent to the lead edge of the carrier layer, which flap covers, secures and protects the lead edge of the fabric layer, thereby preventing printing errors and machine jamming that could be caused by the fabric layer separating from the carrier layer.

In some embodiments, carrier layer 52 further comprises area 80 on surface 62, adhesive 56 is deposited on area 60, adhesive 82 is deposited on area 80, and fabric layer 54 is secured to carrier layer 52 by adhesive 56 bonding portion 70 of surface 66 to surface 58 and adhesive 82 bonding portion 84 of surface 66 to second surface 62. In some embodiments, area 60 is less than or equal to total area 72 of surface 58 and/or area 80 is less than or equal to total area 86 of surface 62. In some embodiments, a combination of area 60 and area 80 is substantially equal to a combination of portion 70 and portion 84 of surface 66. The foregoing embodiments permit image formation on malleable substrates that have up to twice the surface area of one side of the carrier layer. In other terms, a portion of the malleable substrate is secured to each surface of the carrier layer thereby permitting separate image formation on each portion. It should be appreciated that some selection of image location may be necessary, e.g., determining a nature separation line within an image. The foregoing consideration would then control the placement of malleable material on the carrier and the image placement on each surface. For example, a pattern symmetry line may be aligned to an edge of the carrier layer. It should be appreciated that any edge of the carrier layer may be used as the edge over which the malleable material is folded. However, the lead, inner and outer edges are less prone to image errors and machine jamming, failure, etc.

In some embodiments, carrier layer 52 comprises area 80 on surface 62, adhesive 56 is deposited on area 68, and fabric layer 54 is secured to carrier layer 52 by adhesive 56 bonding portion 70 of surface 66 to surface 58 and bonding portion 84 of surface 66 to surface 62. As described above with respect to attachment of a malleable material to a single surface of the carrier layer, adhesive may be deposited on the carrier layer and/or the fabric layer. Thus, in embodiments wherein the fabric layer is wrapped about the carrier layer, adhesive, the same or different, may be applied to each surface of the carrier layer, and/or the non-image bearing surface of the malleable material, as the image bearing surface will always be facing outwardly relative to the carrier layer, i.e., never contacting the carrier layer.

In some embodiments, the present disclosure includes a method of forming image 88 on print media 50. Some embodiments of the method includes: releasably securing fabric layer 54 to carrier layer 52, where carrier layer 52 comprises surface 58 comprising area 60, surface 62 opposite surface 58, and a first rigidity, where fabric layer 54 comprises surface 64, surface 66 opposite surface 64 and comprises area 68, and a second rigidity less than the first rigidity, wherein fabric layer 54 is secured to carrier layer 52 by adhesive 56 bonding portion 70 of surface 66 to surface 58; applying dry marking material 90 to portion 92 of surface 64 of fabric layer 54; and, fusing dry marking material 90 to portion 92 of surface 64 with fuser 94.

In some embodiments of the foregoing method, carrier layer 52 further comprises area 80 on surface 62, adhesive 56 is deposited on area 60, adhesive 82 is deposited on area 80, and fabric layer 54 is secured to carrier layer 52 by adhesive 56 bonding portion 70 of surface 66 to surface 58 and adhesive 82 bonding portion 84 of surface 66 to surface 62. In some embodiments, the foregoing method further comprises: applying dry marking material 96 to portion 98 of surface 64 of fabric layer 54 wherein portion 98 of surface 64 is opposite portion 84 of surface 66; and, fusing dry marking material 96 to portion 98 of surface 64 with fuser 94.

In some embodiments, carrier layer 52 comprises area 80 on surface 62, adhesive 56 is deposited on area 60, and fabric layer 54 is secured to carrier layer 52 by adhesive 56 bonding portion 70 of surface 66 to surface 58 and bonding portion 84 of surface 66 to surface 62.

In some embodiments, the foregoing method further comprises: applying dry marking material 96 to portion 92 of surface 64 of fabric layer 54; and, fusing dry marking material 96 to portion 92 of surface 64 with fuser 100. In some embodiments, the step of applying dry marking material 96 occurs after the step of fusing dry marking material 90. In some embodiments, the step of applying dry marking material 96 occurs after the step of applying dry marking material 90 and before the step of fusing dry marking material 90, and fuser 94 and fuser 100 are the same fuser.

It should be appreciated that in addition to the methods described above, the present disclosure is also directed to methods using liquid marking materials. In some embodiments, the present method of forming image 102 on print media 50 comprising: releasably securing fabric layer 54 to carrier layer 52, carrier layer 52 comprising surface 58 comprising area 60, surface 62 opposite surface 58, and a first rigidity, fabric layer 54 comprising surface 64, surface 66 opposite surface 64 and comprising area 68, and a second rigidity less than the first rigidity, wherein fabric layer 54 is secured to carrier layer 52 by adhesive 56 bonding portion 70 of surface 66 to surface 58; applying liquid marking material 104 to portion 92 of surface 64 of fabric layer 54; and, drying liquid marking material 104 to portion 92 of surface 64 with dryer 106.

It should be further appreciated that various embodiments using a liquid marking material and one or more dryers are substantially similar to the various embodiments described above with respect to dry marking materials and fusers. So, for example, some embodiments may include liquid marking material 108 and dryer 110, in addition to liquid marking material 104 and dryer 106. Moreover, some embodiments further include various other steps, such as the order of depositing liquid marking materials 104 and 108, and the order of using dryer 106 and/or 110, as those steps are described above with respect to dry marking materials 90 and 96 and fusers 94 and 100. In short, all embodiments described above that include dry marking materials and fusers are also applicable to embodiments that include liquid marking materials and dryers.

Depending on the configuration of the printing device, the presently disclosed print media may pass through more than one fuser/dryer, e.g., side sided image formation and duplex printing with a duplex path may require only a single fuser, while duplex printing without a duplex path may require two fusers/dryers. Additionally, in embodiments where a base layer is deposited and fused/dried prior to image formation, more than one fuser/dryer may be required if such operations are not relying on the presence of a duplex path.

In addition to the embodiments of articles, apparatus and methods described above, the present disclosure includes a variety of aspects that fall within the scope of the claims listed herebelow, which aspects will be readily appreciated upon review of the following descriptions.

In some embodiments, the malleable material may benefit from a "pre-treatment" step. For example, fabrics may be porous, and such porosity permits the passage of dry and liquid marking materials. However, an initial deposition of dry and/or liquid marking material, e.g., a base layer, prior to forming an image on the fabric may greatly reduce subsequent passage of marking material through the pores, thereby greatly increasing the final image quality. Thus, an initial deposition of a white dry marking material on a fabric may in effect fill the pores and provide a more consistent base media upon which an image may then be formed.

Additionally, in some embodiments, the printing system may include sensors used to detect the color of the print media, e.g., cream/natural colored cotton, prior to depositing a base layer. The printing system may then be configured to print that custom base layer on the malleable material, i.e., a color matched base layer, prior to forming the image thereon. It should be appreciated that the foregoing custom base layer will result in a greater consistency of background/unprinted material and areas of the malleable material that do not receive marking materials, e.g., outer edges of the malleable material.

Similarly, in some embodiments, the first marking material deposited on the malleable material may act as a base layer that alters the visual appearance of the malleable material, e.g., a glittery or highly reflective layer, and/or may improve adhesion for subsequently deposited marking material, e.g., a primer layer. The foregoing embodiments fall within the scope of the claims directed to applying first and second marking materials.

Moreover, some embodiments, e.g., embodiments including image formation by a dry marking material, may benefit by printing systems that include what is known as an acoustic transfer assist (ATA) device. One of ordinary skill in the art will appreciate that printing systems that use a flexible belt in the process of forming an image thereon and subsequently transferring that image from the flexible belt to print media sometimes include one or more ATA devices. ATA devices use acoustic energy to drive the dry marking material, e.g., toner, from the belt to the print media. Thus, in some embodiments, an ATA device, such ATA device 112, assists with transferring a dry marking material from a belt to the malleable print media so that no direct contact between the belt and malleable material is necessary. It should be appreciated that such an arrangement may minimize image defects and thereby increase image quality. However, it should also be appreciated that conventional transfer of marking material from a drum or other solid object is also possible.

Still yet further, it should be appreciated that the presently described print media may be used in a variety of printing systems. For example, printer 113 in part comprises transfer belt 114, dry marking material dispensers 116, 118, 120 and 122, ATA device 112 and fuser 94, while printer 124 in part comprises transfer belt 114, dry marking material dispensers 116, 118, 120, 122 and 126, ATA device 112 and fuser 94. Similarly, printer 128 in part comprises liquid marking material dispensers 130, 132, 134 and 136 and dryer 106. In some printers, a first dry or liquid marking material is dispensed and fused/dried, followed by subsequent deposition of dry or liquid marking and fusing/drying. For example, printer 138 in part comprises dry marking material dispenser 140, followed by fuser 94, followed by transfer belt 114, dry marking material dispensers 116, 118, 120 and 122, ATA device 112 and fuser 100. In like fashion, printer 142 in part comprises liquid marking material dispenser 144, followed by dryer 106, followed by liquid marking material dispensers 130, 132, 134 and 136, and dryer 110.

Furthermore, the malleable materials may include items that are already formed articles, e.g., t-shirts, blouses, pants, scarfs, etc. Such articles may be positioned on a carrier layer in an orientation that permits forming an image on one or more surfaces of the article, e.g., the front and/or back of a t-shirt. Similarly, houseware articles such as window treatments, e.g., curtains, shower curtains, towels, pillowcases, blankets, etc. may also be secured to a carrier layer for subsequent image formation thereon. In short, any malleable material may be attached to a presently disclosed carrier layer in such a way as to permit forming an image on one or more locations on the material, and the material may already be a formed article.

The present disclosure leverages known and recently developed hardware arrangements for image formation and fuser/dryer technology with a liner-backed malleable material, e.g., fabric, enabling very practical applications for printing on fabrics, such as cotton (natural and synthetic), canvas, etc. In addition to facilitating high image quality printing on malleable materials, the present disclosure also describes how the printable format size can be greatly increased over known system capabilities.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. A method of forming an image on a print media comprising:

releasably securing a fabric layer to a carrier layer, the carrier layer comprising a first surface comprising a first area, a second surface opposite the first surface, and a first rigidity, the fabric layer comprising a third surface, a fourth surface opposite the third surface and comprising a second area, and a second rigidity less than the first rigidity;

applying a first dry marking material to a first portion of the third surface of the fabric layer; and, fusing the first dry marking material to the first portion of the third surface with a first user;

wherein the carrier layer comprises a third area on the second surface, a first adhesive is deposited on the second area, and the fabric layer is secured to the carrier layer by the first adhesive bonding the first portion of the fourth surface to the first surface and bonding a second portion of the fourth surface to the second surface.

2. The method of forming the image on the print media of claim 1, wherein the first adhesive is deposited on the first area, a second adhesive is deposited on the third area, and the fabric layer is secured to the carrier layer by the first adhesive bonding the first portion of the fourth surface to the first surface and the second adhesive bonding the second portion of the fourth surface to the second surface.

3. The method of forming the image on the print media of claim 2, further comprising:

applying a second dry marking material to a second portion of the third surface of the fabric layer wherein the second portion of the third surface is opposite the second portion of the fourth surface; and, fusing the second dry marking material to the second portion of the third surface with the first fuser.

4. The method of forming the image on the print media of claim 1, further comprising:

applying a second dry marking material to a second portion of the third surface of the fabric layer wherein the second portion of the third surface is opposite the second portion of the fourth surface; and, fusing the second dry marking material to the second portion of the third surface with the first fuser.

5. The method of forming the image on the print media of claim 1, comprising:

applying a second dry marking material to the first portion of the third surface of the fabric layer; and, fusing the second dry marking material to the first portion of the third surface with a second fuser.

6. The method of forming the image on the print media of claim 5, wherein the step of applying the second dry marking material occurs after the step of fusing the first dry marking material.

7. The method of forming the image on the print media of claim 5, wherein the step of applying the second dry marking material occurs after the step of applying the first dry marking material and before the step of fusing the first dry marking material, and the first fuser and the second fuser are the same fuser.

* * * * *